United States Patent [19]

Jackson

[11] 4,133,490

[45] Jan. 9, 1979

[54] MACHINE FOR MAKING CELLULOSE INSULATION

[75] Inventor: Joseph E. Jackson, Winchester, Ind.

[73] Assignees: Lewis E. Jones; Forrest E. McMahan, both of Anderson, Ind. ; part interest to each

[21] Appl. No.: 817,026

[22] Filed: Jul. 13, 1977

[51] Int. Cl.[2] ..... B02C 23/02

[52] U.S. Cl. ..... 241/101.6; 241/186 A; 241/186.2; 198/671

[58] Field of Search ..... 241/101 A, 101 B, 101 D, 241/101.4, 101.6, 152, 154, 186 A, 186.2; 198/532, 670, 671; 222/286, 290, 412, 413; 119/52 AF, 53, 56 R

[56] References Cited

U.S. PATENT DOCUMENTS

| | | | |
|---|---|---|---|
| 2,428,100 | 9/1947 | Soulen | 241/101 D |
| 2,470,641 | 5/1949 | Portz | 241/101 A |
| 2,800,252 | 7/1957 | Wahl | 222/413 |
| 3,756,372 | 9/1973 | Martens | 198/532 |
| 3,995,819 | 12/1976 | Kunogi et al. | 241/154 |

*Primary Examiner*—Granville Y. Custer, Jr.
*Attorney, Agent, or Firm*—Clarence A. O'Brien; Harvey B. Jacobson

[57] ABSTRACT

An apparatus for making cellulose insulation including auger feed and metering devices for chemical additives for discharging a measured quantity of such additives into an initial grinder which receives raw paper from a supply source so that an accurately measured proportion of additive will be effectively combined with the paper in the initial grinder. Twin augers convey the combined paper product and chemical additive to a final grinder and an auger conveyor conveys the product to a bagger hopper with twin augers then conveying the product to a bagging station. The use of auger-type conveying and metering devices enables greater efficiency of combining the chemical additive, which is a powder-type material, with the paper and the manufacturing area has less dust particles and this technique substantially eliminates air pollution caused by present processes in which the chemical additives are applied through a high volume fan which creates a major problem of disposing of the large volume of air that has been created. In present day techniques, the large volume of air results in substantial air pollution since the air when it is discharged back into the atmosphere has dust particles or chemical additive particles entrained therein and it is necessary to utilize separating tanks to separate the air from the product prior to the product being bagged.

5 Claims, 7 Drawing Figures

MACHINE FOR MAKING CELLULOSE INSULATION

BACKGROUND OF THE INVENTION

1. Field of the Invention

The present invention generally relates to the manufacture of cellulose insulation in which raw paper is supplied to an initial grinder together with a predetermined quantity of powder-type chemical additive which is fed and metered by an auger screw type of mechanism with the initially ground paper product and chemical additive combined therewith being thoroughly intermingled and combined in the initial grinder and then conveyed to a final grinder by an auger conveyor assembly with auger conveyors also discharging the final product from the final grinder to a hopper and bagger.

2. Description of the Prior Art

Cellulose insulation in the form of shredded or ground paper has obtained substantial acceptance for various reasons such as the effective insulation characteristics thereof, availability of raw material and the like. In the manufacture of cellulose insulation, it is necessary to combine chemical additives thereto such as fire retardants and other additives. These additives are in the form of a powder material since the addition of liquid chemical additives to the paper would require that the paper be thoroughly dried before packaging. Present techniques of combining the chemical additive with the paper is to entrain the powder additive into a high volume airflow which is introduced into an initial grinder for combining with the paper as it is being ground or shredded. The airflow is produced by a large volume fan in which the air effectively disperses the chemical additives so that the chemical additive powder will be effectively combined with the paper product. However, the large fan required and the large duct work associated therewith occupies substantial floor space and the large volume of air produced by the fan presents substantial problems since the air must be separated from the product before the product is bagged thus requiring the use of large separation tanks or other separation devices for separating the large volume of air from the final product. These tanks or separation devices also require substantial space. In addition, the large volume of air discharged into the atmosphere after it has been separated from the final product still has a substantial quantity of the chemical additive entrained therein thus polluting the air in the area surrounding the machinery or plant. It has been found in some installations that vegetation in the area adjacent the manufacturing facilities have been damaged and personnel in the area of such manufacturing facilities sometimes wear filtering devices for cleaning the air which they breathe.

The following U.S. patents relate to devices for mixing and grinding materials and have some degree of pertinency to this invention.

U.S. Pat. No. 2,494,296, U.S. Pat. No. 3,375,985, U.S. Pat. No. 3,652,020, U.S. Pat. No. 3,753,530, U.S. Pat. No. 3,841,465, U.S. Pat. No. 3,215,355.

SUMMARY OF THE INVENTION

An object of the present invention is to provide a machine for making cellulose insulation including screw auger-type feeding and metering means for powder-type chemical additives and screw auger-type conveyors for conveying the mixed paper and chemical additives from an initial to a final grinder and from the final grinder to a hopper and then to a bagging station.

Another object of the invention is to provide a machine for making cellulose insulation in which the screw auger feed and metering conveyor is provided with a movable sleeve for selectively opening and closing an inlet opening in the screw auger housing to provide accurate metering of the quantity of chemical additive that is placed in the initial grinder along with raw paper.

A further object of the invention is to provide a cellulose insulation making machine in accordance with the preceding objects which results in more efficient combination of the chemical additives with the paper which enables a lesser amount of chemical additive to be utilized with a given quantity of paper thereby rendering the process more efficient.

Yet another object of the invention is to provide a process of forming cellulose insulation in which screw auger-type conveyor assemblies are provided for introducing a metered quantity of powder-type chemical additive into an initial grinder which also receives raw paper from a supply source with auger conveyors being provided to convey the combined product from the initial grinder to a final grinder, to convey the final product from the final grinder to a hopper and convey the final product from a hopper to a bagging machine without introduction of large volumes of air such as is conventionally used to convey the chemical additive, combined product and final product.

Still another significant object of the present invention is to provide a machine for and method of forming cellulose insulation by combining powder-type chemical additive with raw paper in the initial grinder, conveying the combined product to a final grinder and conveying the final product from the final grinder to a hopper for subsequent conveying to a bagging machine or the like with the method eliminating the use of large volumes of air thus reducing the size of the machinery involved and reducing the necessity of separating the air from the final product and eliminating environmental pollution by the discharge of large quantities of air into the environment in which the discharged air has entrained chemical additives therein.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
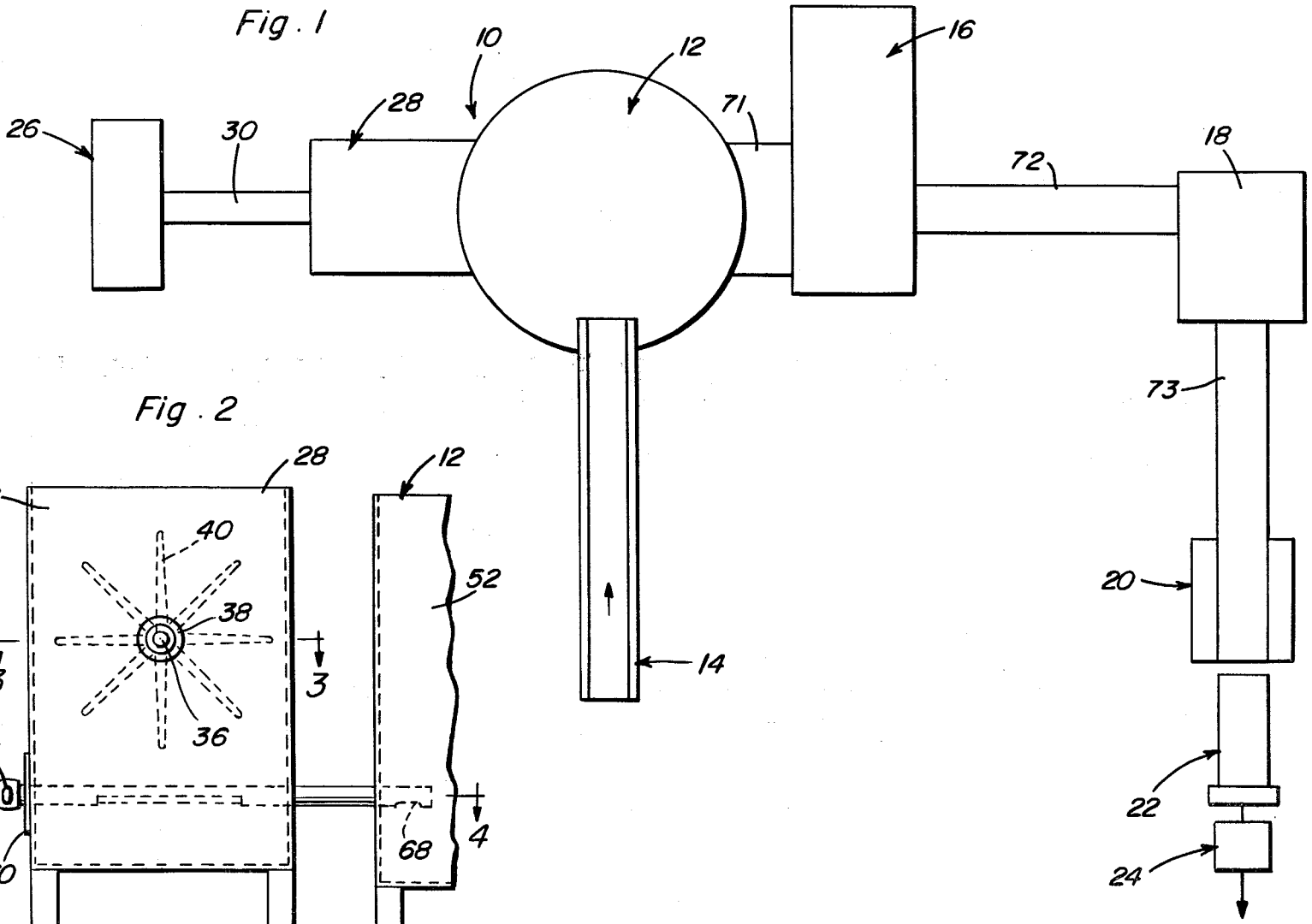
FIG. 1 is a schematic plan view of the apparatus for making cellulose insulation in accordance with the present invention.

FIG. 1 illustrates schematically the machine for making cellulose insulation generally designated by numeral 10 and includes an initial grinder 12 which is in the form of a hammermill and is a conventional grinder employed in the manufacture of cellulose insulation and which receives raw paper from a supply source by a raw paper conveyor 14. Conventional techniques also include a final grinder generally designated by numeral 16 which receives material from the initial grinder and a hopper 18 for receiving the final product from the final grinder, a bagger 20, a bag sewing station 22 and conveying means 24 to convey the bagged insulation to a storage or shipping area. Insofar as the structural details of the raw paper conveyor 14, the initial grinder 12, the final grinder 16, hopper 18, bagger 20, bag sewing station 22 and conveyor 24 are concerned, these are all conventional and form no specific part of the present invention except in their combination with the specific mechanism for adding powder-type chemical additives to the initial grinder and conveying the combined product from the initial grinder to the final grinder and conveying the final product from the final grinder to the hopper and conveying the product from the hopper to the bagger. The hammermill used in the initial grinder consists of a minimum of 60 hammers each hammer having the dimensions of $2\frac{1}{2}'' \times 7\frac{3}{4}'' \times 5/16''$. The hammermill has a cylinder shaft diameter of 3" and a cylinder size of 42" in length and 26" in diameter, with the hammers extended. The screen area of the hammermill is 2,520 square inches while the screen consists of $\frac{5}{8}''$ round holes. The final grinder is identical to the initial grinder, except that the final grinder screen consists of $\frac{1}{4}''$ round holes.

The chemical additive is mixed in a chemical mixer generally designated by the numeral 26 which may be of any suitable construction and is conveyed to a feeding and metering device generally designated by numeral 28 through a screw auger conveyor 30. The exact chemical ingredients such as fire retardants, fungicides, insecticides and the like are combined in the chemical mixer 26 in desired ratios and proportions in the same manner as presently employed. Chemicals used in the process would include boric acid, aluminum sulfate, aluminum trihydrate, and a combination of these ingredients to provide a mix that is suitable for producing a flame retardant product. In conventional practice, the chemical additive is entrained in a flow of air provided by a large volume fan.

In distinction to this, the chemical additive is conveyed to the metering device 28 through a screw auger conveyor 30. The metering device is illustrated in detail since it provides for the introduction of a predetermined quantity of chemical additive into the initial grinder 12 without the use of large volumes of air.

Figure 2:
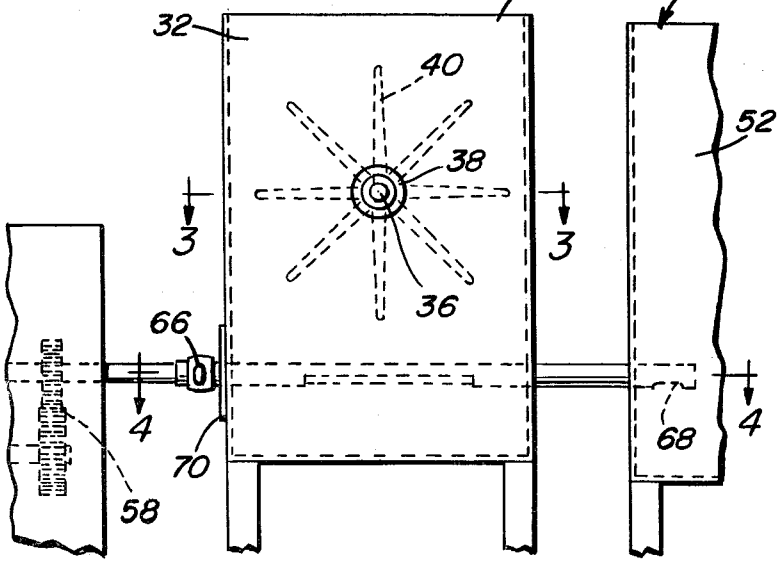
FIG. 2 is an enlarged schematic elevational view illustrating the metering screw auger for the chemical additive of a powder type.
Figure 3:
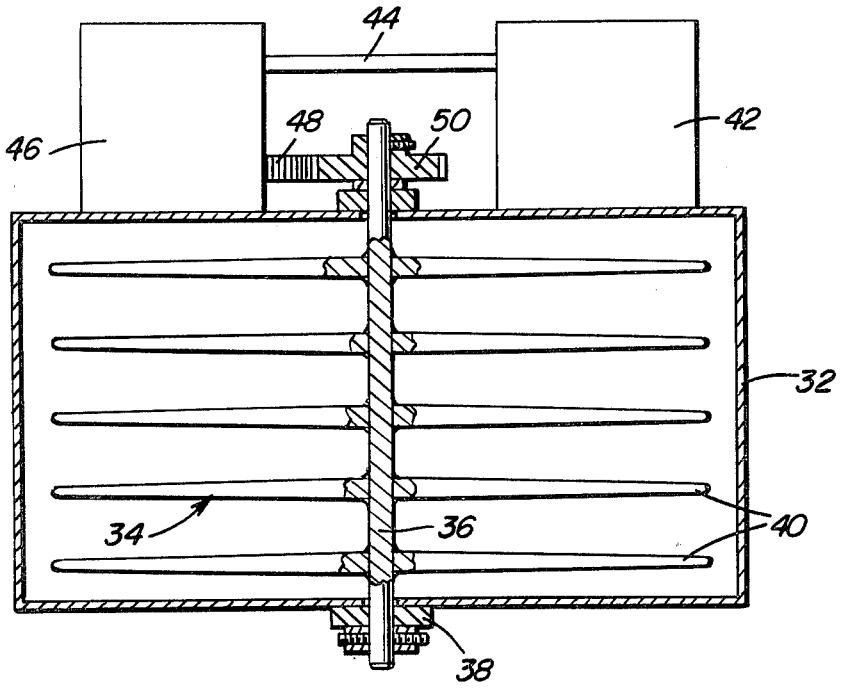
FIG. 3 is a sectional view, on an enlarged scale, taken substantially upon a plane passing along section line 3—3 on FIG. 2 illustrating structural details of the agitator for the chemical additive.
Figure 4:
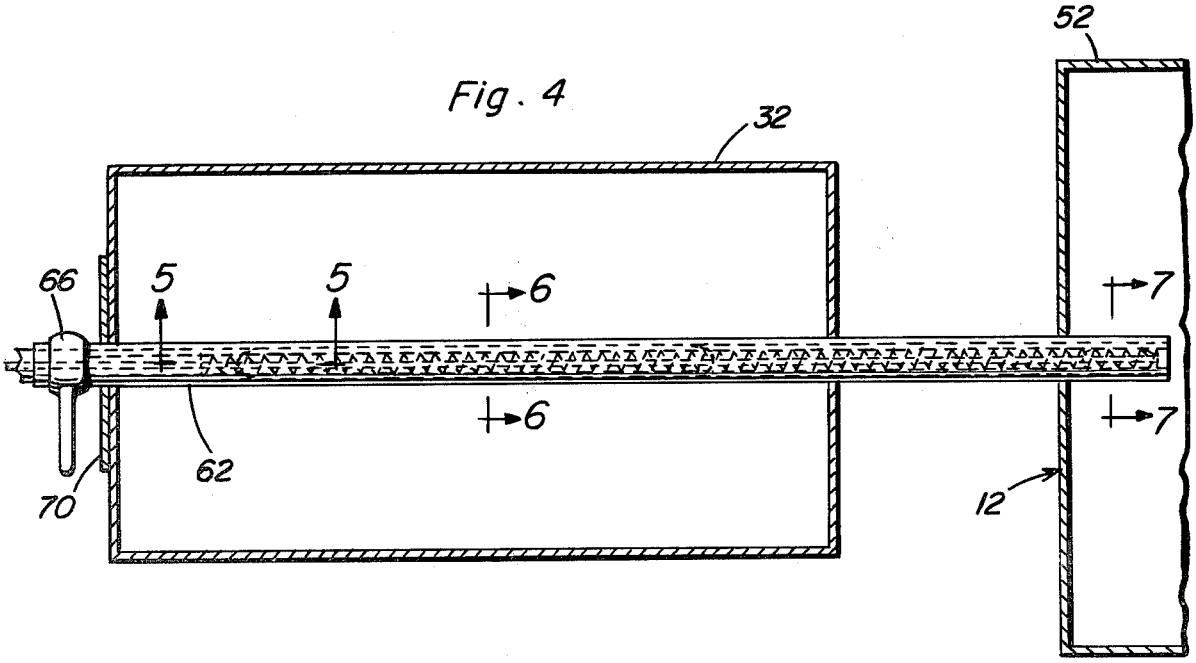
FIG. 4 is a longitudinal, sectional view taken along section line 4—4 of FIG. 2 illustrating the position of the screw auger, the housing therefor and the metering sleeve.
Figure 5:
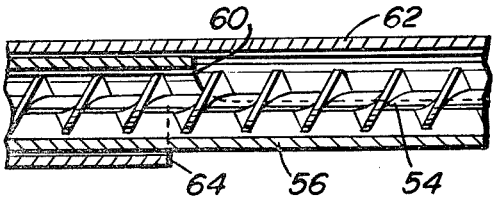
FIG. 5 is a fragmental sectional view taken substantially upon a plane passing along section line 5—5 on FIG. 4 illustrating further structural details of the metering screw.
Figure 6:
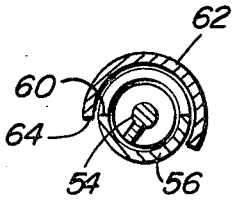
FIG. 6 is a transverse, sectional view taken substantially upon a plane passing along section line 6—6 on FIG. 4 illustrating further structural details of the metering screw.
Figure 7:
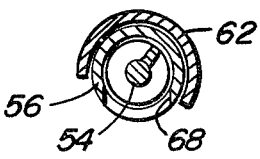
FIG. 7 is a transverse, sectional view taken substantially upon a plane passing along section line 7—7 of FIG. 4 illustrating the discharge end of the metering screw disposed within the initial grinder.

The metering device 28 includes a hopper 32 into which the chemical additive is deposited by the conveyor 30 in any suitable manner. Disposed in the hopper 32 is an agitator generally designated by numeral 34 which includes a central shaft 36 journalled in suitable bearing structures 38 and provided with a plurality of radially extending mixing rods 40 thereon. Thus, as the shaft 36 is driven by a motor 42 having an output shaft 44 which powers a reduction gear assembly 46 which has an output gear 48 in meshing engagement with a gear 50 on the shaft 36, it will agitate the powder-type chemical additive in the hopper 32 to assure proper flow from the hopper 32 into the interior of the housing 52 of the initial grinder 12 as illustrated in FIGS. 2 and 4.

Extending across the bottom of the hopper 32 is a screw auger 54 including a shaft with spiral flighting with a tubular housing 56 therefor. The screw auger extends through the hopper 32 and into the interior of the initial grinder 12. The other end of the auger extends outwardly from the hopper 32 and is driven by a gear assembly 58 connected to a suitable motor having a predetermined, relatively slow output speed from a reduction gear assembly or the like. The housing 56 for the screw auger 54 is provided with an elongated top opening 60 therein within the interior of the hopper 32 to provide inlet of powder-type chemical additive. A sleeve 62 encloses the housing 56 and includes an elongated opening 64 for selective registry with the opening 60 when the sleeve 62 is rotated about the longitudinal axis of the housing 56 which coincides with the rotational axis of the auger 54. The sleeve 62 also extends outwardly of the hopper 32 and is provided with a laterally extending handle 66 by virtue of which the sleeve 62 can be rotated to a desired position for completely closing the opening 60 or completely registering the opening 64 with the opening 60 or varying the size of the opening 60 by positioning the opening 64 in various angularly displaced positions relative to the opening 60. Thus, an accurate control of the size of the discharge opening communicating the hopper 32 with the auger 54 and the interior of the auger housing 60 is obtained.

The screw auger 54, housing 56 and sleeve 62 extends from the hopper 32 into the interior of the housing 52 of the initial grinder where the housing 56 is provided with a discharge opening 68 in the lower portion thereof for gravity discharge of the chemical additive into the initial grinder 12. The handle 66 is associated with an indicator plate or gauge 70 to indicate the quantity of chemical additive being discharged into the initial grinder and the auger 54 is driven by the gear mechanism 58 which is related to the speed of the initial grinder so that a fixed proportion of chemical additive will be added to the initial grinder so that the ratio of chemical additive to the paper will be maintained substantially constant.

The use of the auger for feeding a metered quantity of chemical additive into the initial grinder eliminates a large volume air fan and corresponding large ducts. Twin auger conveyors generally designated by numeral 71 convey the combined initially ground or shredded paper product and chemical additive from the initial grinder to the final grinder and a screw auger conveyor 72 conveys the final product from the final grinder 16 to the storage hopper 18 for the bagger 20 with a screw auger conveyor 74 conveying the final product from the hopper to the bagger 20. Thus, the elimination of the large volume of air enables screw auger conveyors of a relatively small size as compared to large volume air ducts to be utilized throughout the apparatus.

The use of the large volume air fan for induction of powdered chemicals into the cellulose insulation apparently was developed in order to breakup the powdered chemicals to obtain maximum benefit from the chemicals when combining the same with the shredded paper. However, in tests conducted with the screw auger metering device, it has been found that a greater combination efficiency is obtained with the auger process thus enabling less chemical additive to be used for a given quantity of paper product which results in substantial reduction in manufacturing costs of the cellulose insulation. It was also found that due to the more efficient combination of the chemical additive with the paper, substantially less settling out of unground chemicals was found in the bottom of the bags of bagged cellulose insulation. In addition to saving in the cost of the chemical additive, substantial reduction in cost of machinery was experienced along with a substantial reduction in the space required for the machinery. Further, the manufacturing process was less costly since the large volumes of air did not have to be separated and various cleaning and filtering procedures employed on the air discharged into the atmosphere are no longer necessary and even with such filters, the large volumes of air had a certain amount of chemical additive entrained therein when discharged into the atmosphere thus resulting in air pollution. This efficiency of combining the materials is believed to be derived primarily from insertion of the chemicals in the initial grinder where they are actually ground and mixed through two hammermills.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a cellulose insulation making apparatus of the type having means for grinding raw paper into desired size particles, in which chemical additive of the powder-type is combined with the ground paper, that improvement comprising a screw auger means forming the sole means for feeding and metering a quantity of powder-type chemical additive into the grinder means for homogenous application to the paper particles, and screw auger means conveying the final product from the grinding means, wherein said feeding and metering screw auger means includes a hopper for powder-type chemical additive, a screw auger shaft with spiral flighting thereon extending through the bottom portion of the hopper, a housing for said shaft, said housing including air inlet opening in the top portion thereof, adjustable closure means for variably closing off said opening for varying the quanity of material passing therethrough and variable setting means for setting said closure means at positions between a fully open position and a fully closed position.

2. The structure as defined in claim 1 wherein said auger shaft and housing extend into the grinder means with the housing having a discharge opening interiorly of the grinder means for gravity discharge of additive into the grinder means.

3. The structure as defined in claim 1 wherein said grinder means includes an initial grinder and a final grinder and screw auger means interconnecting the initial and final grinder thereby mechanically conveying the cellulose insulation forming material throughout the apparatus without entrainment in a large volume airflow.

4. In a cellulose insulation making apparatus of the type having means for grinding raw paper into desired size particles, in which chemical additive of the powder-type is combined with the ground paper, that improvement comprising a screw auger means forming the sole means for feeding and metering a quantity of powder-type chemical additive into the grinder means for homogenous application to the paper particles, and screw auger means conveying the final product from the grinding means, wherein said feeding and metering screw auger means includes a hopper for powder-type chemical additive, a screw auger shaft with spiral flighting thereon extending through the bottom portion the hopper, a housing for said shaft, said housing including air inlet opening in the top portion there, and adjustable closure means for variably closing off said opening for varying the quantity of material passing therethrough and wherein said closure means includes a tubular sleeve having an opening therein, said tubular sleeve being movably mounted on the housing for selective and adjustable registry of the openings in the housing and sleeve.

5. The structure as defined in claim 4 wherein said housing and sleeve are cylindrical in configuration with the sleeve being rotatably mounted on the housing, said sleeve extending outwardly of the hopper, and handle means on the sleeve for rotating the sleeve on the housing, said handle means being disposed externally of the hopper to provide access thereto.

* * * * *